US010876743B2

(12) United States Patent
Komatsu et al.

(10) Patent No.: US 10,876,743 B2
(45) Date of Patent: Dec. 29, 2020

(54) HOT-WATER SUPPLY UNIT AND HOT-WATER SUPPLY SYSTEM

(71) Applicant: Mitsubishi Electric Corporation, Tokyo (JP)

(72) Inventors: Masayuki Komatsu, Tokyo (JP); Kei Yanagimoto, Tokyo (JP); Yuki Ogawa, Tokyo (JP); Keisuke Takayama, Tokyo (JP); Takashi Ogawa, Tokyo (JP); Naoki Barada, Tokyo (JP); Satoshi Nomura, Tokyo (JP); Tadahiko Inaba, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 273 days.

(21) Appl. No.: 15/758,811

(22) PCT Filed: Nov. 27, 2015

(86) PCT No.: PCT/JP2015/083323

§ 371 (c)(1),
(2) Date: Mar. 9, 2018

(87) PCT Pub. No.: WO2017/090168

PCT Pub. Date: Jun. 1, 2017

(65) Prior Publication Data

US 2019/0086102 A1 Mar. 21, 2019

(51) Int. Cl.
*F24H 1/18* (2006.01)
*F24D 19/10* (2006.01)
(Continued)

(52) U.S. Cl.
CPC ..... *F24D 19/1081* (2013.01); *F24D 12/02* (2013.01); *F24D 15/02* (2013.01);
(Continued)

(58) Field of Classification Search
USPC ..... 392/464
See application file for complete search history.

(56) References Cited

U.S. PATENT DOCUMENTS 4,449,178 A * 5/1984 Blau, Jr. ..... G05D 23/1923 219/492
4,645,908 A * 2/1987 Jones ..... F24D 11/0214 392/340

(Continued)

FOREIGN PATENT DOCUMENTS

JP 2013-064602 A 4/2013
JP 2013-178009 A 9/2013

(Continued)

OTHER PUBLICATIONS

JP 2013-064602a, "Water Heater Control Device," Unezaki et al, Apr. 2013, partial translation.*

(Continued)

*Primary Examiner* — Joseph M. Pelham
(74) *Attorney, Agent, or Firm* — Posz Law Group, PLC

(57) ABSTRACT

A settings data storage stores unique serial numbers and information regarding a plurality of patterns for alternately switching between normal operation for operating at high capacity and suppressed operation for operating at low capacity each unit time. A pattern specifier determines information for a pattern set in accordance with even and odd serial numbers. A water-heating heat amount determiner determines a heat amount necessary for water heating. A water heating scheduler establishes a water heating plan based on information regarding the pattern determined by the pattern determiner and the water-heating heat amount as determined by the water-heating heat amount determiner. A water heating controller alternately switches between normal operating and suppressed operation to heat water in accordance with the water heating plan established by the water heating scheduler.

6 Claims, 11 Drawing Sheets

(51) Int. Cl.

| | |
|---|---|
| ***F24H 4/04*** | (2006.01) |
| ***F24H 9/20*** | (2006.01) |
| ***F24D 17/02*** | (2006.01) |
| ***F24D 12/02*** | (2006.01) |
| ***F24D 15/02*** | (2006.01) |
| ***F24H 1/20*** | (2006.01) |
| ***F24H 9/02*** | (2006.01) |

(52) U.S. Cl.

CPC ..... *F24D 17/02* (2013.01); *F24D 19/1054* (2013.01); *F24D 19/1063* (2013.01); *F24D 19/1072* (2013.01); *F24H 1/201* (2013.01); *F24H 4/04* (2013.01); *F24H 9/02* (2013.01); *F24H 9/2021* (2013.01); *F24D 2200/08* (2013.01); *F24D 2200/12* (2013.01); *F24D 2200/123* (2013.01)

(56) References Cited

U.S. PATENT DOCUMENTS

| | | | | |
|---|---|---|---|---|
| 5,317,670 | A * | 5/1994 | Elia | F24D 19/1051 126/362.1 |
| 8,422,870 | B2 * | 4/2013 | Nelson | F24H 4/04 392/461 |
| 2014/0037275 | A1 * | 2/2014 | Flohr | F24H 1/201 392/464 |

FOREIGN PATENT DOCUMENTS

| | | | |
|---|---|---|---|
| JP | 2014-119217 | A | 6/2014 |
| JP | 2014-126351 | A | 7/2014 |
| JP | 2014-137200 | A | 7/2014 |
| JP | 2014-240711 | A | 12/2014 |
| JP | 2015-206496 | A | 11/2015 |

OTHER PUBLICATIONS

Office action dated Jun. 4, 2019 issued in corresponding JP patent application No. 2017-552623 (and English translation thereof).
Extended European Search Report dated Nov. 6, 2018 issued in corresponding European patent application No. 15909285.7.
Office Action dated Sep. 29, 2019 issued in corresponding CN patent application No. 201580084716.7 (and English translation).
International Search Report of the International Searching Authority dated Feb. 23, 2016 for the corresponding international application No. PCT/JP2015/083323 (and English translation).
Office action dated Nov. 13, 2018 issued in corresponding JP patent application No. 2017-552623 (and English translation thereof).
Chinese Office Action dated Mar. 16, 2020 issued in corresponding CN patent application No. 201580084716.7 (and English translation).
Chinese Office Action dated Jul. 9, 2020 issued in corresponding CN patent application No. 201580084716.7 (and partial English translation).
Office Action dated Jul. 31, 2020 issued in corresponding EP patent application No. 15909285.7.

* cited by examiner

FIG. 4

| TIME PERIOD NUMBER | TIME PERIOD | KW | HEAT AMOUNT |
|---|---|---|---|
| 16 | 23:00～23:30 | 6 | HEAT AMOUNT 16 |
| 15 | 23:30～0:00 | 3 | HEAT AMOUNT 15 |
| 14 | 0:00～0:30 | 6 | HEAT AMOUNT 14 |
| 13 | 0:30～1:00 | 3 | HEAT AMOUNT 13 |
| 12 | 1:00～1:30 | 6 | HEAT AMOUNT 12 |
| 11 | 1:30～2:00 | 3 | HEAT AMOUNT 11 |
| 10 | 2:00～2:30 | 6 | HEAT AMOUNT 10 |
| 9 | 2:30～3:00 | 3 | HEAT AMOUNT 9 |
| 8 | 3:00～3:30 | 6 | HEAT AMOUNT 8 |
| 7 | 3:30～4:00 | 3 | HEAT AMOUNT 7 |
| 6 | 4:00～4:30 | 6 | HEAT AMOUNT 6 |
| 5 | 4:30～5:00 | 3 | HEAT AMOUNT 5 |
| 4 | 5:00～5:30 | 6 | HEAT AMOUNT 4 |
| 3 | 5:30～6:00 | 3 | HEAT AMOUNT 3 |
| 2 | 6:00～6:30 | 6 | HEAT AMOUNT 2 |
| 1 | 6:30～7:00 | 3 | HEAT AMOUNT 1 |

HOT-WATER SUPPLY UNIT AND HOT-WATER SUPPLY SYSTEM

CROSS REFERENCE TO RELATED APPLICATION

This application is a U.S. national stage application of International Patent Application No. PCT/JP2015/083323 filed on Nov. 27, 2015, the disclosure of which is incorporated herein by reference.

TECHNICAL FIELD

The present disclosure relates to a water heater and a water heating system.

BACKGROUND ART

Nowadays, a hot-water storage type water heater equipped with a hot water tank is becoming more prevalent. This water heater is a type of water heater that stores pre-heated water in a hot-water tank and uses the hot water.

A water heater of this type usually performs a water-heating operation during a late-night time period during which the electricity rate is inexpensive. Therefore, when, for example, water heaters become widely prevalent in condominiums with collective high-voltage power reception service and in smart-towns promoting the use of renewable energy, the water heaters begin operation together late at night inadvertently causing peak power to arise during the late-night time period. When this peak power arises, this could cause the electricity rate to soar even during the late-night time period when the electricity rate is supposed to be inexpensive. In such a case, this could impede further market penetration of the water heater due to the diminished operational cost advantage of the water heater.

As a recent technology that suppresses such kind of peak power from arising, Patent Literature 1, for example, discloses a technique of performing peak-shifting by postponing the start of operation (water-heating operation) of a water heater to a more appropriate time after a start time of a late-night time period.

CITATION LIST

Patent Literature

Patent Literature 1: Unexamined Japanese Patent Application Kokai Publication No. 2014-240711

SUMMARY OF INVENTION

Technical Problem

However, even if a technique such as that disclosed in Patent Literature 1 is employed, peak power will still arise during the late-night hours when the number of water heaters in use increases somewhat. In other words, even though the peak-shift technique in Patent Literature 1 can suppress peak power from arising around the start time of the late-night time period, peak power still arises once enough water heaters begin operation thereafter.

Conceivably, peak power could be suppressed from arising by collectively controlling operation of water heaters on a per-condominium or per-region basis. However, even these options could be problematic in that constant control of each of the water heaters would become necessary and control details could get complicated. Therefore, there is a demand for a technique that could appropriately suppress peak power from arising, with a simplified and convenient structure.

In order to solve the aforementioned issues, an objective of the present disclosure is to provide a water heater and a water heating system that can appropriately suppress peak power from arising, with a simplified and convenient structure.

Solution to Problem

In order to attain the aforementioned objective, a hot-water storage type water heater according to the present disclosure includes control means for alternately switching between a first operation and a second operation to heat water in accordance with an operation pattern of a plurality of operation patterns, the operation pattern being determined by a predetermined value, the first operation operating at a high capacity, the second operation operating at a capacity lower than that of the first operation.

Advantageous Effects of Invention

According to the present disclosure, the water heater autonomously performs a water-heating operation alternately switching between a first operation (normal operation, for example) and a second operation (suppressed operation, for example). When doing so, the water heater determines, for example, an operation pattern from pattern A and pattern B in accordance with whether the serial number is an even serial number or an odd serial number. Therefore, even when, for example, water heaters become prevalent in a condominium or region, operation patterns are assigned in a substantially equal manner among the numerous water heaters and executed accordingly, and overall the peak power can be suppressed from arising. As a result, peak power can be appropriately suppressed from arising, with a simplified and convenient structure.

BRIEF DESCRIPTION OF DRAWINGS

FIG. 4 is a diagram demonstrating an accumulation of an amount of heat;

Hereinafter, embodiments of the present disclosure are described in detail with reference to the drawings.

EMBODIMENT 1

Figure 1:
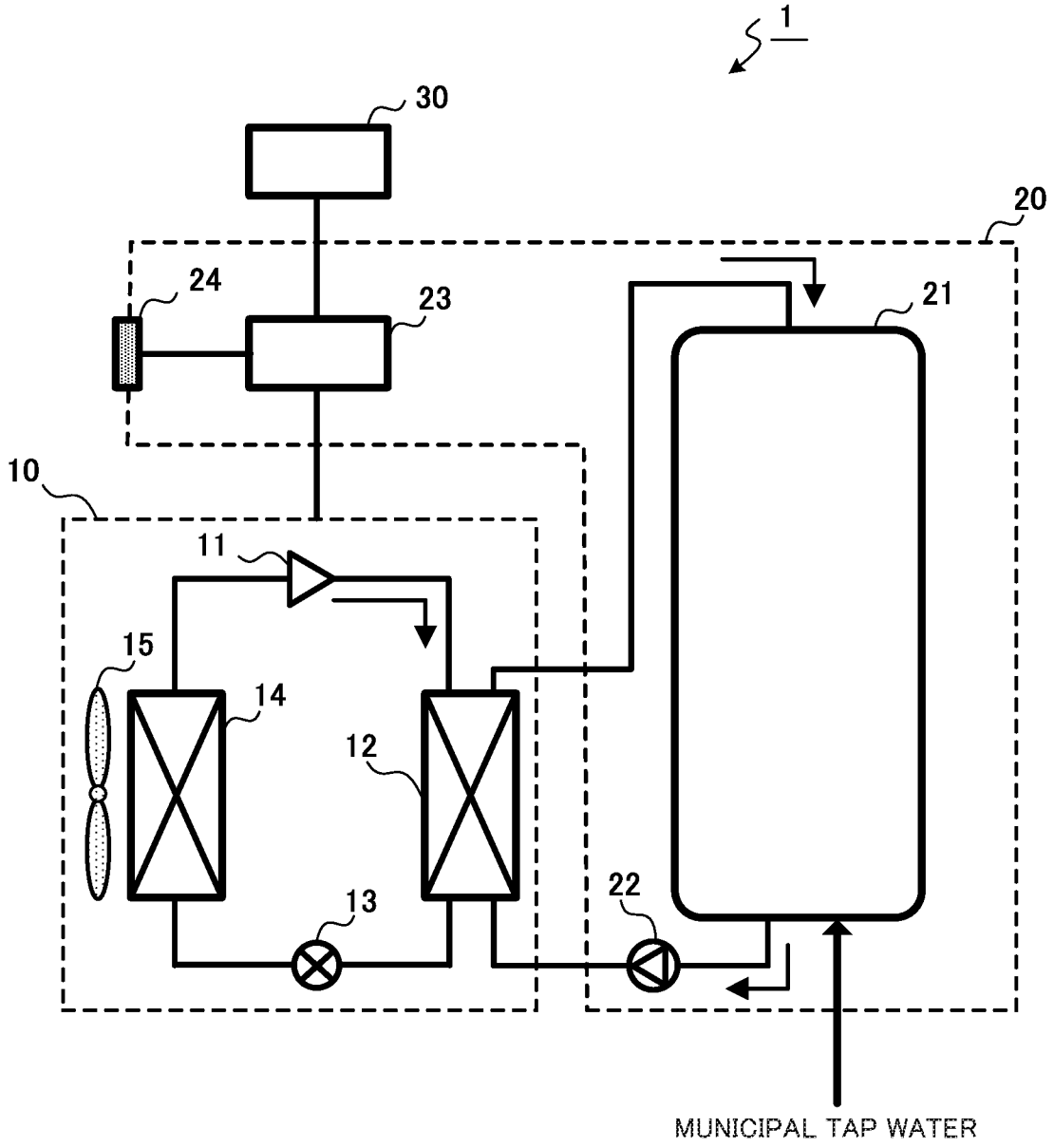
FIG. 1 is a block diagram illustrating an example configuration of a water heater according to Embodiment 1 of the present disclosure.

FIG. 1 is a block diagram illustrating an example configuration of a water heater 1 according to Embodiment 1 of the present disclosure. The water heater 1 is a hot-water storage type water heater that includes a heat pump unit 10, a tank unit 20, and a remote controller 30.

As described further below, the water heater 1 autonomously performs a water-heating operation while alternately switching between high capacity (a first operation, more specifically a normal operation described further below) and a low capacity (a second operation, more specifically a suppressed operation described further below) each unit time. Also, multiple operation patterns for switching between the high capacity and the low capacity are defined. The water heater 1 determines one operation pattern in accordance with whether the pre-set number (for example, a serial number described further below) is even or odd, and performs a water-heating operation. Therefore, even when there are numerous water heaters 1 (water heaters 1*a*, 1*b*, . . . ) because, for example, the water heaters 1 become prevalent in a region or a condominium with collective high-voltage power reception service, operation patterns are assigned in a substantially equal manner among the numerous water heaters 1 and executed accordingly, and therefore overall the peak power can be suppressed from arising.

The heat pump unit 10 is a heat pump that uses refrigerant such as CO2 or a hydrofluorocarbon (HFC). The heat pump unit 10 includes a compressor 11, a water-refrigerant heat exchanger 12, an expansion valve 13, an air heat exchanger 14, and a blower device 15. The compressor 11, the water-refrigerant heat exchanger 12, the expansion valve 13, and the air heat exchanger 14 are connected in a loop shape by piping and together form a refrigeration cycle circuit (refrigerant circuit) for circulating refrigerant.

The compressor 11 raises the temperature and pressure by compressing the refrigerant. The compressor 11 includes an inverter circuit that can change a capacity (feed-out amount per unit) in accordance with a drive frequency.

The water-refrigerant heat exchanger 12 is a heating source for heating municipal tap water until the water temperature elevates to a target water-heating temperature (hot water storage temperature). The water-refrigerant heat exchanger 12 is a plate-type or a double-pipe type heat exchanger that performs heat exchange between refrigerant and water (low temperature water). Through heat exchange in the water-refrigerant heat exchanger 12, heat dissipates from the refrigerant causing the temperature to decrease and the water absorbs heat causing the temperature to rise.

The expansion valve 13 allows expansion of the refrigerant causing the pressure and temperature to rise.

The air heat exchanger 14 performs heat-exchange between the refrigerant and outside air blown in by the blower device 15. Through heat-exchange by the air heat exchanger 14, the refrigerant absorbs heat causing the temperature of the refrigerant to rise, and heat from the outside air is released causing and the temperature of the refrigerant to decrease.

The blower device 15 blows outside air to the air heat exchanger 14.

Also, the heat pump unit 10 includes a non-illustrated temperature sensor for measuring the outside air temperature for example.

Such a heat pump unit 10 has a heating capacity that is proportional to power consumption, and this capacity is mainly controlled by controlling the frequency of the compressor 11. For example, a suppressed operation can be performed that suppress heating capacity and power consumption by suppressing the frequency of the compressor 11 to no greater than a certain frequency.

The tank unit 20 includes a hot water tank 21, a water pump 22, a control board 23, and an indicator 24. These components are housed in, for example, an outer case made of metal (a portion of the indicator 24 is at the surface of the case).

The hot water tank 21 is formed of a material such as metal (stainless steel, for example) or a resin. Insulation material (not illustrated) is disposed on an outer portion of the hot water tank 21. Therefore, the hot water in the hot water tank 21 can be maintained at a high temperature for a long period of time.

The hot water tank 21, the water pump 22, and the water-refrigerant heat exchanger 12 of the heat pump unit 10 are connected to one another by piping, forming a water-heating circuit for circulating hot water from the lower portion of the hot water tank 21, via the water pump 22 and the water-refrigerant heat exchanger 12, back to the top portion of the hot water tank 21.

The water pump 22 transfers low temperature water from the bottom portion of the hot water tank 21 to the water-refrigerant heat exchanger 12.

The control board 23 includes, for example, a central processing unit (CPU), a read-only memory (ROM), a random-access memory (RAM), a communication interface, a readable/writable non-volatile semiconductor memory, all of which are not illustrated, and performs overall control of the water heater 1. Further below, the control board 23 is described in detail.

The indicator 24 includes, for example, an LED display and a liquid crystal display and displays, under the control of the control board 23, information regarding the water heater 1. Specifically, the indicator 24, as described further below, displays an operation pattern (pattern A or pattern B, for example) set to the water heater 1.

Also, the tank unit 20 includes a non-illustrated temperature sensor for measuring the water temperature (remaining hot water temperature and/or the water-heating temperature) in the hot water tank 21 and/or a non-illustrated hot water level gauge for measuring the remaining hot water amount in the hot water tank 21.

The remote controller 30 includes, for example, an operating panel and a display, and is operated by a user. The remote controller 30 receives a manual operation performed by the user on the operating panel and notifies the control board 23 regarding the operation details. Also, the display of the remote controller 30 displays, under the control of the control board 23, various sorts of information regarding the water heater 1. For example, the display displays information such as the water-heating setting temperature, remaining hot water amount, and the operation status (also including the operation pattern set to the water heater 1 described further below).

Figure 2:
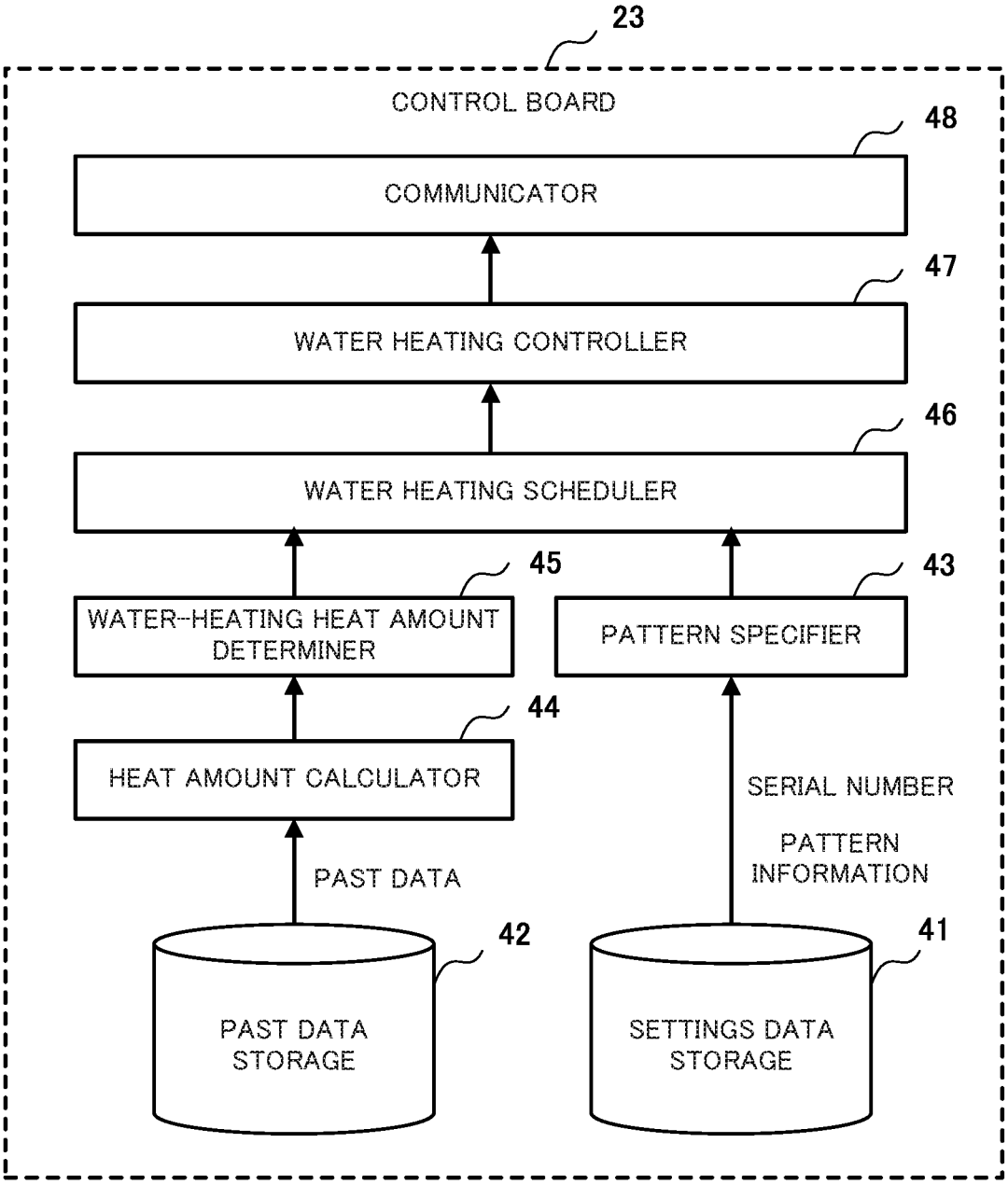
FIG. 2 is a block diagram illustrating an example configuration of a control board.

Next, the control board 23 of the tank unit 20 is described with reference to FIG. 2. FIG. 2 is a block diagram illustrating an example configuration of the control board 23.

The control board 23 includes a settings data storage 41, a past data storage 42, a pattern specifier 43, a heat amount calculator 44, a water-heating heat amount determiner 45, a water heating scheduler 46, a water heating controller 47, and a communicator 48. The functions of the pattern specifier 43, the heat amount calculator 44, and the water-heating heat amount determiner 45, the water heating scheduler 46, and the water heating controller 47 are achieved by the CPU's using the RAM as working memory and appropriately executing, for example, various types of programs stored in the ROM.

The settings data storage 41 stores various types of settings data pertaining to the water heater 1. For example, the settings data storage 41 stores a serial number unique to the water heater 1 and pattern information defining operation patterns. Various pre-determined patterns (multiple types) constitute the pattern information and the water-heating operation of the water heater 1 is controlled in accordance with one pattern of the pattern information.

Figure 3:
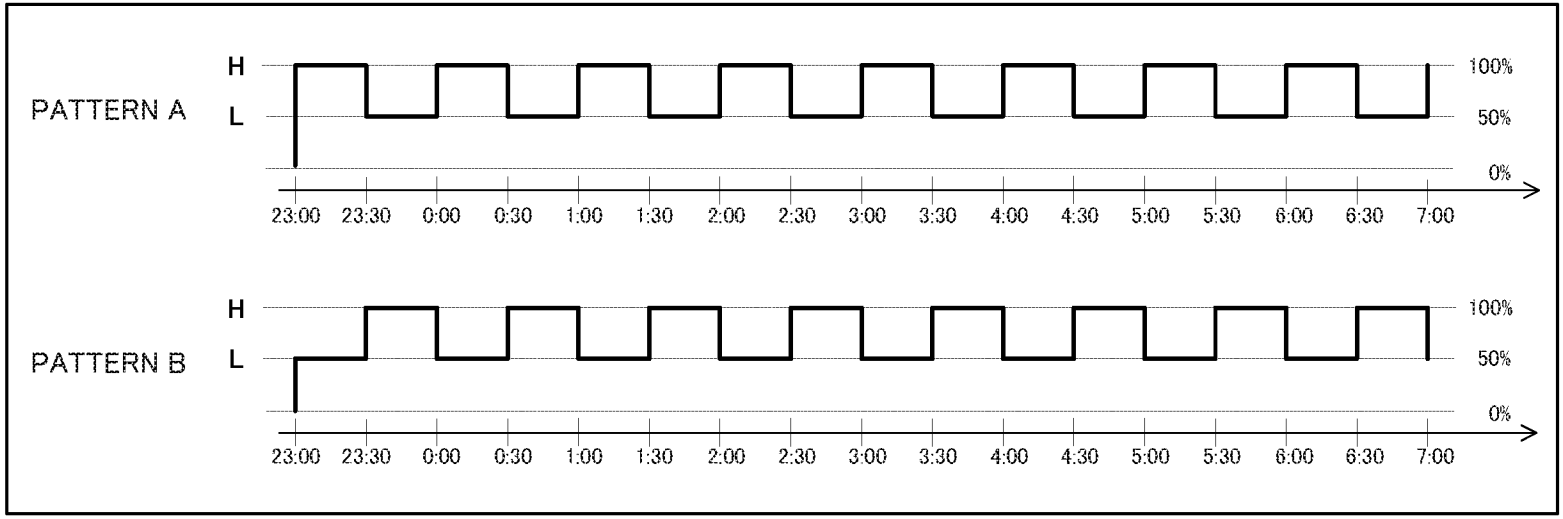
FIG. 3 is a diagram demonstrating two types of pattern information.

Specifically, the settings data storage 41 stores two types of pattern information (patterns A and B) as illustrated in FIG. 3. As illustrated in FIG. 3, the pattern information defines division of the late-night time period ((23:00 to 7:00) (24-hour time period), as one example) into segments of unit time (30 minutes, as one example) and switching between normal operation H (high capacity: 100% capacity) and suppressed operation L (low capacity: 50% capacity) each unit time. Also, pattern A and pattern B are set such that the timing of normal operation H and the timing of suppressed operation L are different with respect to each other (such that the phases are inverted with respect to each other). Normal operation H and suppressed operation L may be described using different expressions. For example, normal operation H may be referred to as a first operation and suppressed operation L may be referred to as a second operation.

In other words, pattern A is defined as an operation pattern in which normal operation H is performed from n o'clock to thirty minutes after n o'clock and suppressed operation L is performed from thirty minutes after n o'clock to (n+1) o'clock. Conversely, pattern B, is defined as an operation pattern in which suppressed operation L is performed from n o'clock to thirty minutes after n o'clock and normal operation H is performed from thirty minutes after n o'clock to (n+1) o'clock. In FIG. 3, normal operation H is indicated as being at 100% capacity, whereas suppressed operation L is indicated as being at 50% capacity. This is merely an example and can be modified as appropriate. In particular, the capacity of suppressed operation L, as is described further below, may be modified from 40% capacity up to 50% capacity. Also, the unit time is not limited to 30 minutes and may be modified as appropriate to, for example, 60 minutes or 45 minutes. Furthermore, the pattern information is not limited to these patterns A and B and as is described further below, the pattern information may contain other patterns.

Returning back to FIG. 2, the past data storage 42 stores past usage heat amounts in the water heater 1. For example, the past data storage 42 stores a cumulative usage heat amount (past data) being a two to four-week accumulation of daily heat usage heat amounts.

The pattern specifier 43 retrieves a serial number and pattern information from the settings data storage 41 and specifies (determines) an operation pattern to be adopted by the water heater 1. For example, the pattern specifier 43 specifies the pattern operation to be pattern A when the serial number is an even number. Conversely, when the serial number is an odd number, the pattern specifier 43 specifies the operation pattern to be pattern B. This is an example method for specifying the operation pattern and may be modified as appropriate. For example, as described further below, the operation pattern to be adopted by the water heater 1 may be determined in accordance with even and odd numbers of a numerical value other than serial numbers.

The heat amount calculator 44 retrieves past data (cumulative usage heat amount) from the past data storage 42 and calculates an average value of a usage heat amount in the water heater 1 for a single day. For example, the heat amount calculator 44 calculates an average usage heat amount Qave by dividing the cumulative usage heat amount by the cumulative number of days.

The water-heating heat amount determiner 45 determines a water-heating heat amount for performing water heating during a late-night time period. For example, the water-heating heat amount determiner 45 subtracts a remaining hot water heat amount Qt from a target value (target heat amount Qo) of a heat amount to be stored in the hot water tank 21 to determine the water-heating heat amount Qn (Qn=Qo−Qt). The target heat amount Qo is obtained by equation 1 indicated below.

$$Qo=(Qave\times\text{heat loss coefficient}+\text{start-up heat amount})\times\text{nighttime rate} \quad \text{(Equation 1)}$$

In Equation 1, the heat loss coefficient is a value (1.1, for example) accounting for heat dissipation from the hot water tank 21 until a user uses the hot water, with respect to a heat amount at which the heat pump unit 10 performed heating. Also, the start-up heat amount is the tank heat amount condition (3500 kcal, for example) computed from the remaining hot water amount in the hot water tank 21 in a case where a hot water storage operation starts during a daytime period. Also, the nighttime rate is a percentage (80%, for example) of power amount used during a late-night time period with respect to a power amount used over a 24-hour time period. These values are previously stored in the ROM of the control board 23.

Also, the remaining hot water heat amount Qt is obtained from, for example, the current remaining hot water temperature acquired by the temperature sensor and/or remaining hot water amount acquired by the hot water amount gauge.

The water heating scheduler 46 determines a water heating start time based on the operation pattern specified by the pattern specifier 43 and the hot-water heat amount as determined by the water-heating heat amount determiner 45, and establishes a control schedule from the start of water heating to the end of water heating. For example, the water heating scheduler 46 determines a water heating start time by going in reverse chronology from the end time (7:00, for example) of the late-night time period by the amount of time necessary to perform the water-heating operation.

Specifically, as one example where the pattern specifier 43 specifies the pattern operation to be pattern A, the water heating scheduler 46 alternatingly cumulates, in reverse chronology from time period number 1 (6:30 to 7:00), the heat amounts during suppressed operation L and the heat amounts during normal operation H as in illustrated FIG. 4. Then, when the cumulative heat amount exceeds the water-heating heat amount Qn, the water heating scheduler 46 sets the water heating start time to that particular time. In other words, the water heating scheduler 46 sets the water heating start time to the time at which the condition of "water-heating heat amount Qn<Σ (heat amount 1 to heat amount i)" is satisfied.

As an example, the heat amount during suppressed operation L and the heat amount during normal operation H can be obtained in the manner described below.

$$\text{Heat amount [kCal] during suppressed operation } L=860\ [\text{cal/Wh}]\times 3.0\ [\text{kW}]\times 0.5\ [\text{h}]$$

$$\text{Heat amount [kCal] during normal operation } H=860\ [\text{cal/Wh}]\times 6.0\ [\text{kW}]\times 0.5\ [\text{h}]$$

The different values, 3.0 [kW] and 6.0 [kW], in the equations are electric power [kW], being in proportion to the power consumption [kW]:

$$\text{power consumption [kW]}=\text{electric power [kW]}/\text{COP},$$

where COP represents the coefficient of performance.

Further, although 3.0 [kW] is used for obtaining the heat amount during suppressed operation L, this is meant to indicate that suppressed operation L is performed at a capacity of 50%. In water heater 1, the capacity of suppressed operation L is variable at 5% increments from a capacity of 40% up to a capacity of 50% (the range of change and the increment size may be adjusted as appropriate). In other words, in a case in which suppressed operation L is performed at a capacity of 40%, 2.4 [kW] is used, whereas in a case in which suppressed operation L is performed at 45%, 2.7 [kW] is used.

Therefore, the water heating scheduler 46 initially performs the calculation "heat amount [kCal] during suppressed operation L=860 [cal/Wh]×2.4 [kW]×0.5 [h]" and, if, after having cumulating the heat amounts in reverse chronology until the start time of the late-night time period also known as time period number 16, the cumulative heat amount does not exceed the water-heating heat amount Qn, the water heating scheduler 46 increases the capacity during suppressed operation L by 5% and performs calculation again. One of the following methods is adopted if, the heat amount T does not exceed the water-heating heat amount Qn even when the heat amounts over the late-night time period back to the start time thereof are cumulated with the capacity of suppressed operation L increased to 50%.

Method 1: The duration of the time of the late-night time period is extended either backward or forward in time or both backward and forward in time to keep water heating operation performing continuously under suppressed operation L at 50% capacity.

Method 2: The water-heating operation is completed when the amount of hot water reaches the amount that can be produced during the late-night time period. Additional water heating is subsequently performed during the daytime in accordance with a midday usage amount to recover the amount of hot water used.

The user is allowed to freely set (select) which one of these methods is to be adopted and the setting details are stored, for example, in the settings data storage 41.

Figure 5:
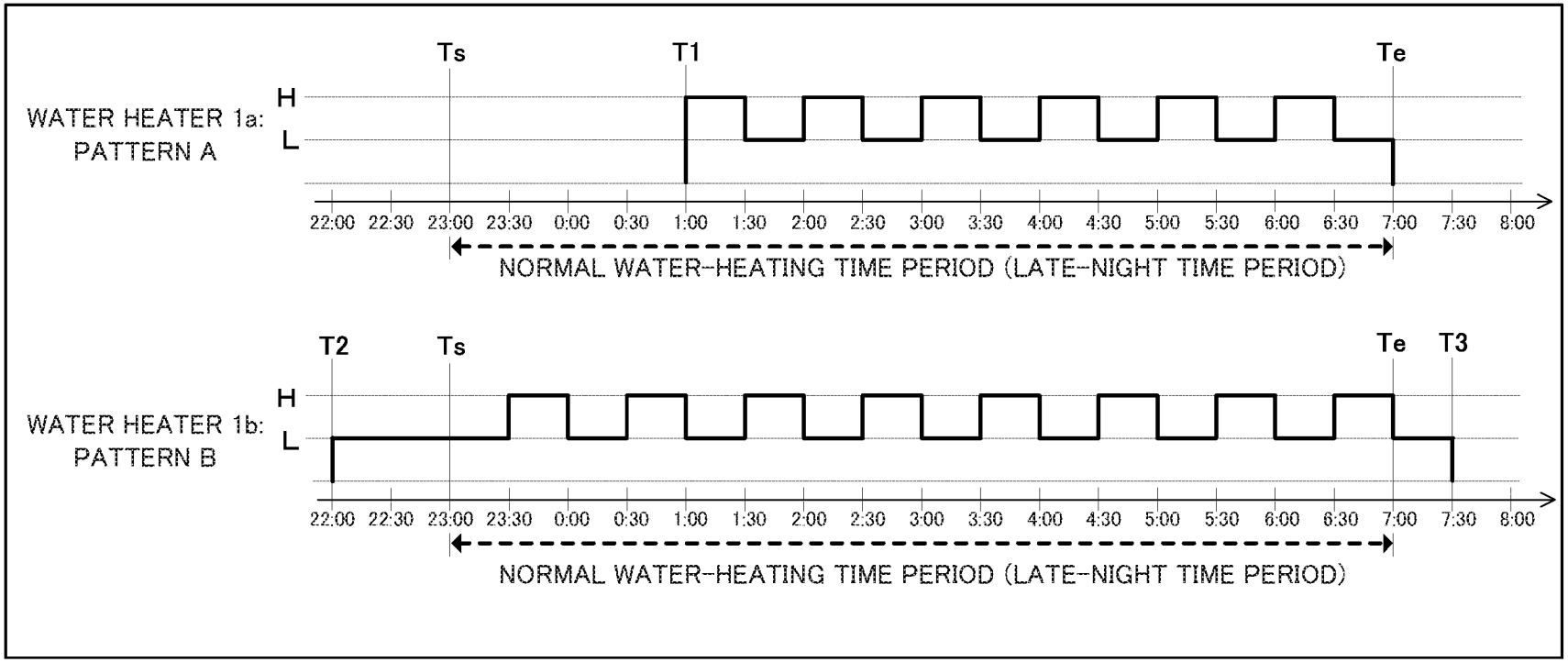
FIG. 5 is a diagram demonstrating an operation plan following two types of operation patterns.

Specifically, in water heater 1*a* specified to follow pattern A, the water heating scheduler 46 establishes a plan for performing a water heating operation from time T1 (1:00) to time Te (7:00) as illustrated in FIG. 5. This plan, following pattern A, starts water-heating operation at time T1 under normal operation H, and then alternately switches between normal operation H and suppressed operation L each unit time (30 minutes) until time Te.

Conversely, in the water heater 1*b* specified to follow pattern B, the water heating scheduler 46 establishes a plan for performing a water heating operation from time T2 (22:00) to time T3 (7:30) as illustrated in FIG. 5. This example shows a case where the method 1 described above is used to address a situation in which the water heating is not completed by the end of the normal water-heating time period (late-night time period). In this example, the duration of time of the late-night time period is extended backward and forward in time. In other words, in this plan water-heating operation is performed under suppressed operation L at 50% capacity from time T2 to time Ts (23:00), then, from time Ts to time Te, water-heating operation is performed in accordance with pattern B, alternately switching between suppressed operation L and normal operation H, and then from time Te to time T3, water-heating operation is performed under suppressed operation at 50% capacity.

Returning back to FIG. 2, upon arrival of the water heating start time determined by the water heating scheduler 46, the water heating controller 47 performs a water-heating operation in accordance with the established plan (plan following the operation pattern specified by the pattern specifier 43).

For example, the water heating controller 47, in accordance with the aforementioned plan illustrated in FIG. 5, transmits to the heat pump unit 10 a capacity control signal every 30 minutes (at n o'clock and at thirty minutes after n o'clock), and executes capacity control accordingly. A technique of controlling the revolution frequency of the compressor 11 is one specific example of capacity control of the heat pump unit 10.

The pattern A based plan and the pattern B based plan as described above and illustrated in FIG. 5 define that the timing of normal operation H and the timing of suppressed operation L are different with respect to each other (such that the phases are inverted with respect to each other) during the late-night time period. As such, the water heating controller 47 in each of the water heaters 1 (water heaters 1*a*, 1*b*, . . . ) can reduce the peak when performing the water heating control, by approximately 25% compared with conventional technology. Therefore, the peak power can be suppressed from arising in the entirety of a condominium or a region.

The communicator 48 communicates with the remote controller 30 to receive manual operations from a user and to transmit information regarding the water heater 1. The communicator 48 as described further below may be capable of communicating with other devices such as a management device.

Figure 6:
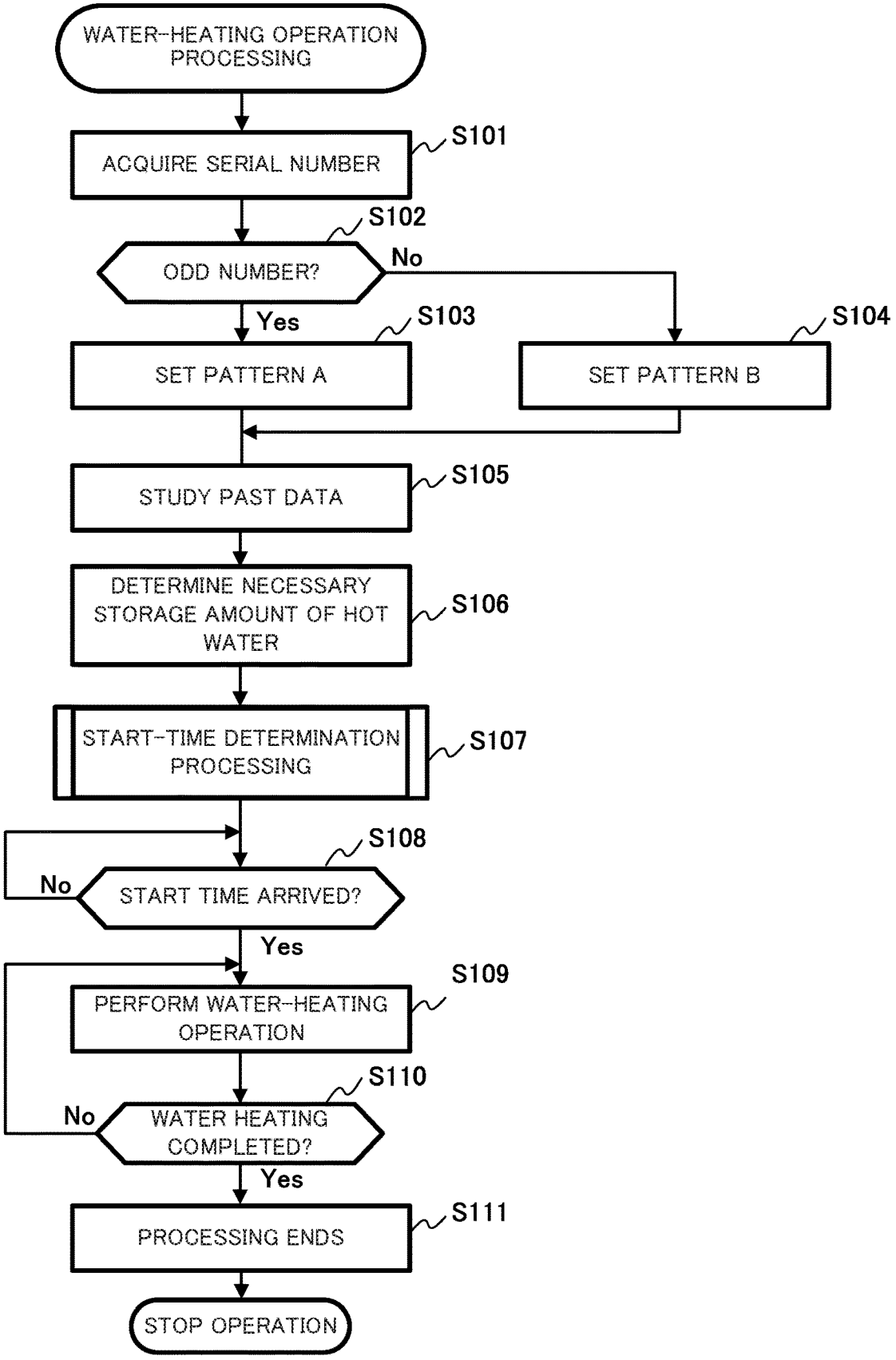
FIG. 6 is a flowchart illustrating an example of water-heating operation processing.
Figure 7:
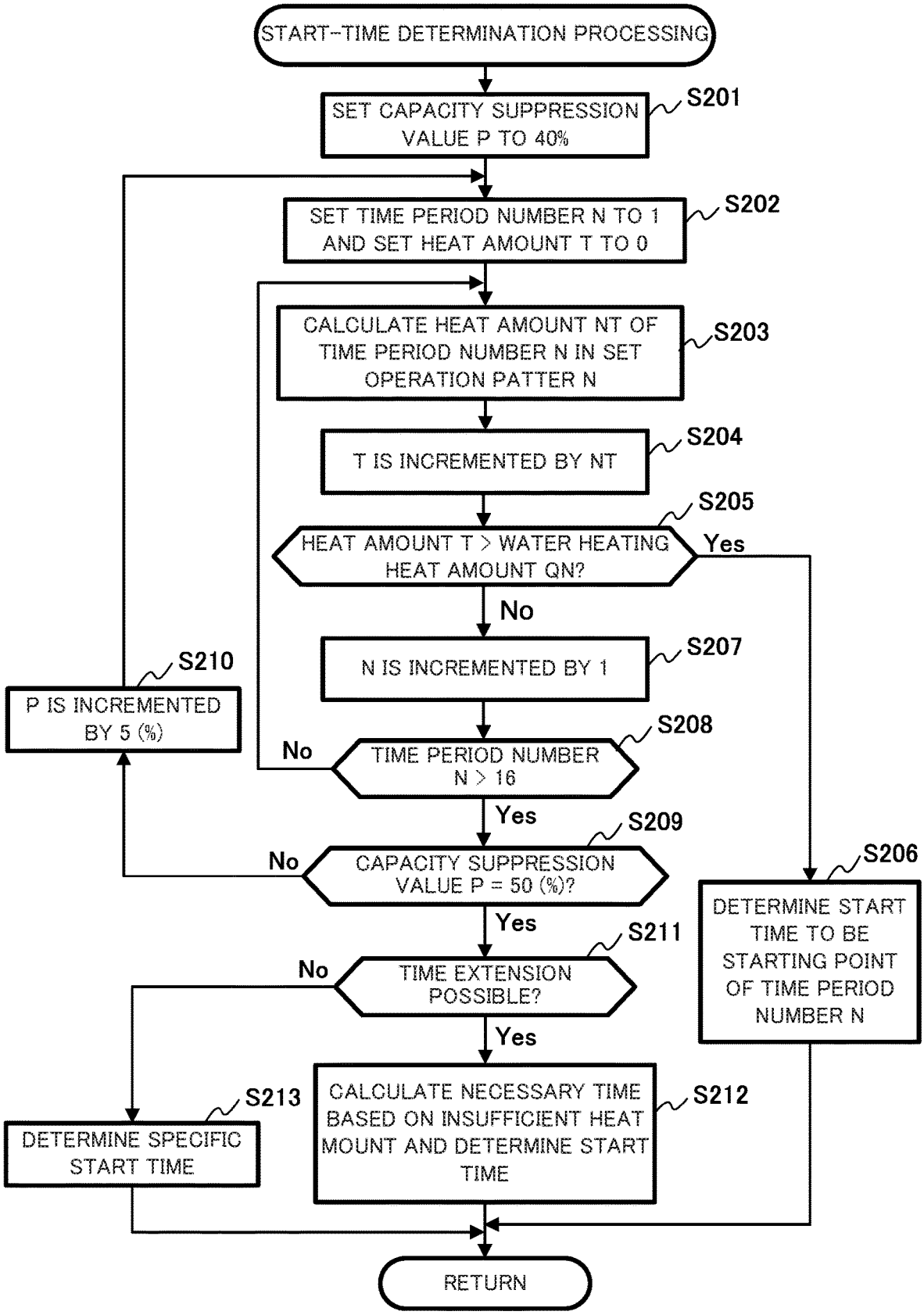
FIG. 7 is a flowchart illustrating details of start-time determination processing.

The operations of the water heater 1 (control board 23) according to Embodiment 1 of the present disclosure are described below with reference to FIGS. 6 and 7. FIG. 6 is a flowchart illustrating an example of water-heating operation processing that is executed by the control board 23. Also, FIG. 7 is a flowchart illustrating details of start-time determination processing in FIG. 6. The water-heating operation processing illustrated in FIG. 6 starts at a predetermined planning time.

First, the control board 23 acquires a serial number (step S101). That is, the pattern specifier 43 retrieves the unique serial number from the settings data storage 41.

The control board 23 determines whether or not the serial number is an odd number (step S102). When the control board 23 determines that the serial number is an odd number (YES in step S102), the operation pattern is set to pattern A (step S103). Conversely, when the control board 23 determines that serial number is not an odd number (is an even number)) (NO in step S102), the control board 23 sets the operation pattern to pattern B (step S104).

The control board 23 studies the past data (step S105). That is, the heat amount calculator 44 retrieves the past data (cumulative usage heat amount) from the past data storage 42 and calculates an average single-day usage heat amount value. For example, the heat amount calculator 44 calculates the average usage heat amount Qave by dividing the cumulative usage heat amount by the cumulative number of days.

The control board 23 determines the necessary storage amount of hot water (step S106). That is, the water-heating heat amount determiner 45 determines the water-heating heat amount for heating water during a late-night time period. For example, the water-heating heat amount determiner 45 subtracts a remaining hot water heat amount Qt from a target value (target heat amount Qo) of a heat amount to be stored in the hot water tank 21 to determine the water-heating heat amount Qn (Qn=Qo−Qt).

The control board 23 performs start-time determination processing (step S107). This start-time determination processing is executed as illustrated in FIG. 7.

In FIG. 7, the water heating scheduler 46 (control board 23) sets the capacity suppression value P to an initial value of 40% (step S201). This capacity suppression value P indicates the capacity during suppressed operation L.

The water heating scheduler 46 sets the time period number N to an initial value of 1 and sets the heat amount T to an initial value of 0 (step S202). The time period number N indicates the aforementioned time period number illustrated in FIG. 4 and is used for going back in order from the end time of the late-night time period. Also, the heat amount T indicates an accumulation of heat amounts that are cumulated in reverse chronology.

The water heating scheduler 46 calculates the heat amount NT of a time period number N in the set operation pattern (step S203). In other words, if the operation for a time period number N is suppressed operation L, the water heating scheduler 46 calculates the heat amount during suppressed operation L. Conversely, if the operation for a time period number N is normal operation H, the water heating scheduler 46 calculates a heat amount during normal operation H.

The water heating scheduler 46 increments the heat amount T by a heat amount NT in the time period number N (step S204).

The water heating scheduler 46 determines whether or not the heat amount T exceeds the water-heating heat amount Qn (step S205). The water heating scheduler 46, as described above, obtains the water-heating heat amount Qn by subtracting the remaining heat amount Qt from the target heat amount Qo.

When determining that the heat amount T exceeds the water-heating heat amount Qn (Yes in step S205), the water heating scheduler 46 determines the start time to be the starting point of the time period number N (a leading time of time period number N) (step S206). The water heating scheduler 46 then ends the start time determination processing in FIG. 7.

Conversely, when determining that the heat amount T does not exceed the water-heating heat amount Qn (No in step S205), the water heating scheduler 46 increments the time period number N by 1 (step S207).

The water heating scheduler 46 determines whether or not the value of the time period number N exceeds 16 (step S208). That is, the water heating scheduler 46 determines whether or not the increment takes the time period of interest backward in time earlier than the start time (23:00) of the late-night time period.

When determining the value of the time period number N does not exceed the 16 (No in step S208), the water heating scheduler 46 returns processing to the aforementioned step S203.

Conversely, when determining that the value of the time period number N does exceed 16 (Yes in step S208), the water heating scheduler 46 determines whether or not the capacity suppression value P is 50% (step S209). That is, the water heating scheduler 46 determines whether an increase has been made to 50% being the upper limit during suppressed operation L.

When determining that the capacity suppression value P is not 50% (No in step S209), the water heating scheduler 46 increments the capacity suppression value P by 5% (step S210). Then, processing is returned to aforementioned step S202.

Conversely, when determining that the capacity suppression value P is 50% (Yes in step S209), the water heating scheduler 46 determines whether or not time can be extended (step S211). In other words, the water heating scheduler 46 determines whether the settings data storage 41 stores the setting details that adopt the aforementioned method 1 in the case in which the heat amount T does not exceed the water-heating heat amount Qn even if the heat amounts over the late-night time period back to the start time thereof are cumulated with the capacity of suppressed operation L increased to 50%.

When determining that a time extension is possible (Yes in steps S211), the water heating scheduler 46 calculates the necessary time based on the insufficient heat amount, and determines the start time (step S212). The water heating scheduler 46 then ends the start-time determination processing of FIG. 7.

Conversely, when determining that time extension is not possible (No in step S211), the water heating scheduler 46 determines the specific start time (step S213). For example, the water heating scheduler 46 determines the starting point (23:00, for example) of the late-night time period to be the start time. The water heating scheduler 46 then ends the start time determination processing of FIG. 7.

Returning back to FIG. 6, the control board 23 remains in standby until the arrival of the determined start time (step S108). Specifically, the control board 23 compares the determined start time against the current time and withholds from executing subsequent processing when a determination is made that the arrival of the start time has yet to arrive (No in step S108).

Upon arrival of the start time (Yes in step S108), the control board 23 performs the water-heating operation (step S109). That is, the water heating controller 47 performs the water-heating operation in accordance with the plan (plan following the operation patterns specified by the pattern specifier 43) established by the water heating scheduler 46.

The control board 23 determines whether or not water heating is completed (step S110). In other words, the control board 23 determines whether or not water heating completion is detected. If the control board 23 determines that the water heating is not yet completed (No in step S110), then the control board 23 returns processing to the aforementioned step S109.

Conversely, when the control board 23 determines that the water heating is completed (Yes in step S110), then the control board 23 stops the operation (step S111). The control board 23 then ends the water-heating operation processing.

This kind of water-heating operation processing in the water heaters 1 (water heaters 1*a*, 1*b*, . . . ) is executed on a per-apparatus basis. In other words, each of the water heaters 1 performs a water-heating operation while autonomously switching, in an alternating manner, between normal operation H and suppressed operation L each unit time. In the operation, each of the water heaters 1 determines the operation pattern to be pattern A or pattern B in accordance with its own serial number (even or odd number), and performs the water heating operation accordingly. Therefore, even when there are numerous water heaters 1 because, for example, the water heaters 1 become prevalent in a region or condominium with collective high-voltage power reception service, operation patterns are assigned in a substantially equal manner among the numerous water heaters 1 and executed accordingly, and therefore overall the peak power can be suppressed from arising.

As a result, peak power can be appropriately suppressed from arising, with a simplified and convenient structure.

Also, if retail electricity providers or aggregators are notified that such kind of operations for suppressing peak power from arising are adopted, other beneficial services may be provided such as an extended late-night time period (late-night time period billing rates apply even when extended). In such a case, this could provide impetus for making adoption of the water heater 1 even more widespread.

MODIFIED EXAMPLE OF EMBODIMENT 1

Aforementioned Embodiment 1 describes the case in which an operation pattern is determined to be pattern A or pattern B in accordance with specific serial numbers (even and odd numbers), but the operation pattern may be determined in accordance with another value. For example, the settings data storage 41 may store in advance values set by an installation technician via the remote controller 30 so that the operation pattern is determined to be pattern A or pattern B in accordance with the values. In other words, the installation technician sets each water heater 1 with a value in accordance with an installation plan such that even and odd numbers are assigned in a substantially equal manner among the water heaters 1. Specifically, in a case in which the water heater 1 is installed in each living unit in a condominium, the installation technician may set each water heater 1 with a value such as a room number, a floor number, a condominium building number and the like such that even and odd numbers are assigned in a substantially equal manner among the water heaters 1.

As another alternative, the water heater 1 may be equipped with a dedicated switch and the operating pattern may be determined to be pattern A or pattern B depending on whether the dedicated switch is turned ON or OFF (ON setting corresponds to even numbers and OFF setting corresponds to odd numbers, for example). In this case as well, the installation technician performs settings based on an installation plan such that the ON settings and the OFF settings of the dedicated switches are assigned in a substantially equal manner among the water heaters 1.

Although aforementioned Embodiment 1 describes the case in which one of two patterns is determined as the operation pattern, an operation pattern may be determined from among other patterns in addition to pattern A and pattern B.

For example, in a case in which a water-heating operation only requires approximately two to three hours for completion because the amount of hot water to be heated in the water heater 1 is small and the operation is performed under normal operation H, an operation pattern may be determined to be a first-half pattern performed only during the first half of the late-night time period or a second-half pattern performed only during the second half of the late-night time period. The first-half pattern and the second-half pattern may also be determined in accordance with the specific serial numbers (even and odd numbers), set values (even and odd numbers), or a dedicated switch (ON and OFF). However, since the second-half pattern is more advantageous than the first-half pattern, fixing of the patterns is not preferred. Therefore, as described further below, a determination is made such that the first-half pattern operation and the second-half pattern operation are rotated as appropriate.

Figure 8:
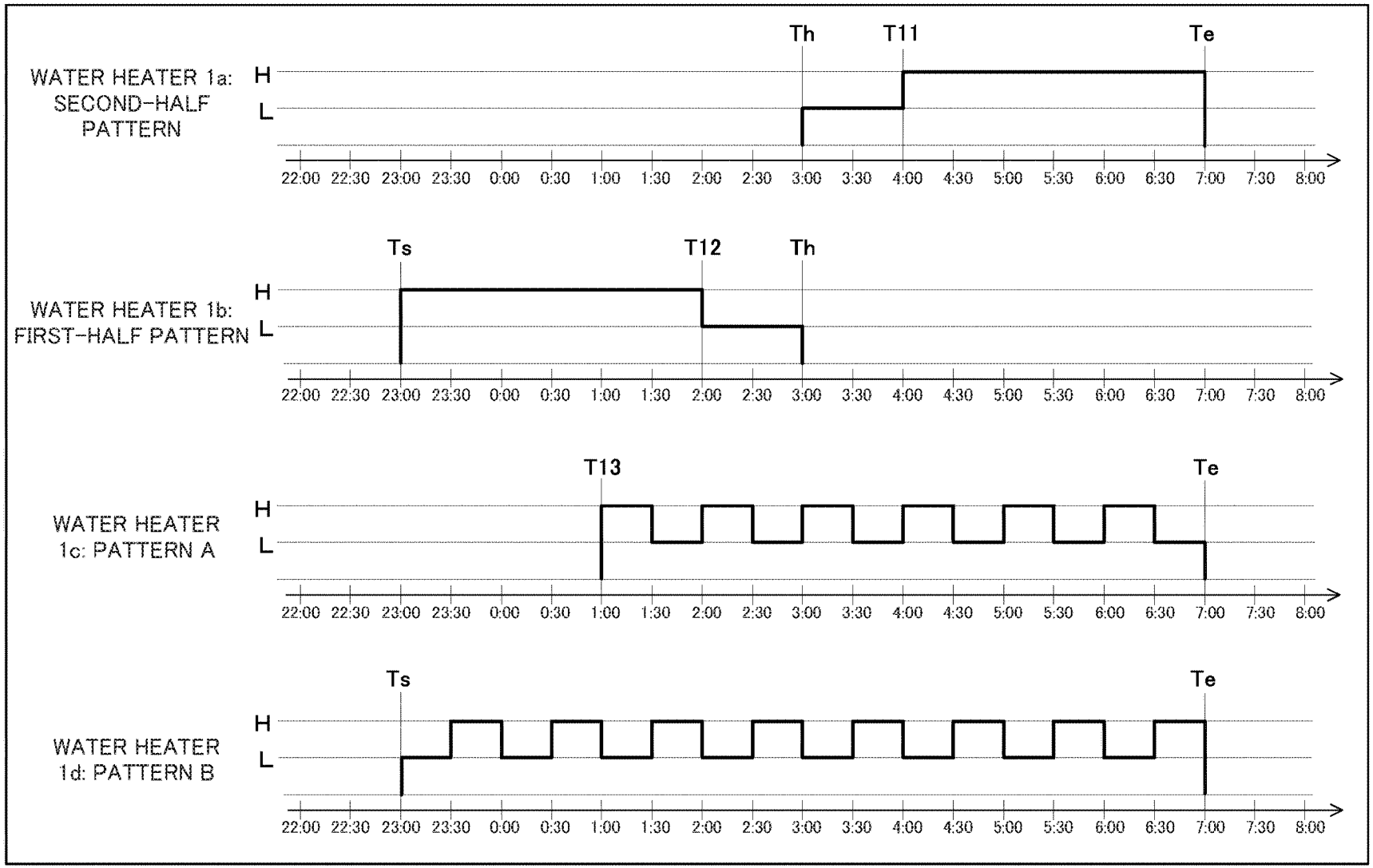
FIG. 8 is a diagram demonstrating an operation plan following four types of operation patterns.

Specifically, in the water heater 1*a* specified to follow the second-half pattern, the water heating scheduler 46 establishes a plan to perform a water-heating operation from time Th (3:00) to time Te (7:00), as illustrated in FIG. 8. In this plan, water-heating operation starts under suppressed operation L from time Th and this operation continues as is until time T11, and then from time T11 to time Te the water-heating operation is performed under normal operation H.

Contrary to this, in the water heater 1*b* specified to follow the first-half pattern, the water heating scheduler 46 establishes a plan to perform a water-heating operation from time Ts (23:00) to time Th as illustrated in FIG. 8. In this plan, water-heating operation starts under normal operation H from time Ts and this operation continues as is until T12, and then from time T12 to time Th water-heating operation is performed under suppressed operation L.

In a case in which a water-heating operation, although under normal operation H, takes over 3.5 hours because the amount of water to be heated is large, which of pattern A and pattern B is followed is determined in accordance with the specific serial numbers (even and odd numbers), set values (even and odd numbers), or a dedicated switch (ON and OFF).

In other words, in the water heater 1*c* specified to follow pattern A, the water heating scheduler 46 establishes a plan to perform a water-heating operation from time T13 (1:00) to time Te as illustrated in FIG. 8. This plan, following pattern A, starts water-heating operation from time T13 under normal operation H alternately switching between normal operation H and suppressed operation L each unit time (30 minutes) until time Te.

Also, in the water heater 1*d* specified to follow pattern B, the water heating scheduler 46 establishes a plan to perform a water-heating operation from time Ts to time Te as illustrated in FIG. 8. In this plan, water-heating operation is performed in accordance with pattern B alternately switching between suppressed operation L and normal operation H until time Te.

Such kind of a plan based on the second-half pattern and the first-half pattern stipulates that the operation times do not overlap with each other during the late-night time period. Also, as described above, the plan following pattern A and pattern B is set such that the timing of normal operation H and the timing of suppressed operation L are different from each other during the late-night time period. Therefore, the water heating controller 47 in each of the water heaters 1 (water heaters 1*a*, 1*b*, 1*c*, 1*d*, . . . ) can reduce the peak when performing water heating control. Therefore, the peak power can be suppressed from arising in the entirety of a condominium or a region.

Figure 9:
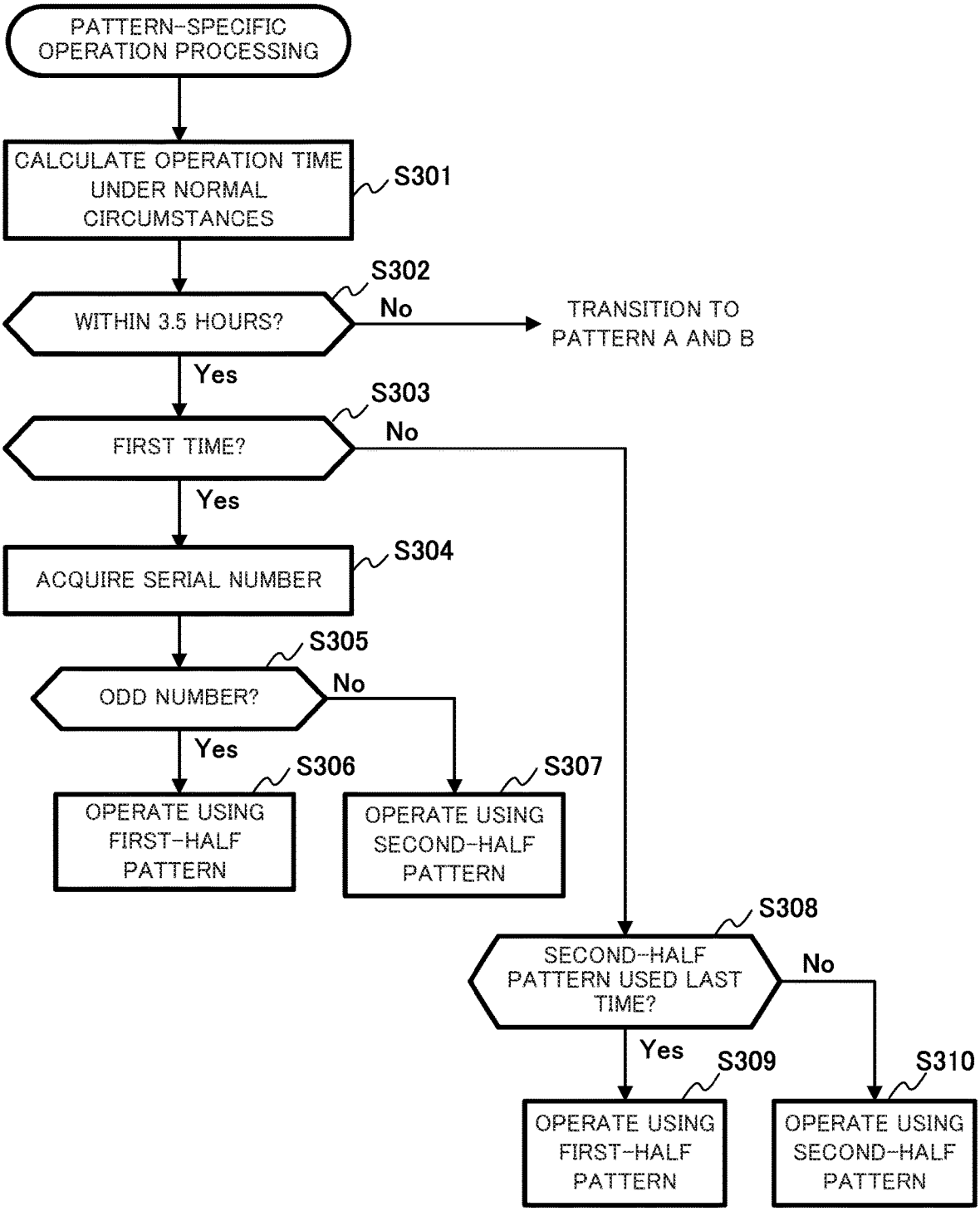
FIG. 9 is a flowchart illustrating an example of pattern-specific operation processing.

Below, the operations for the water-heating operation including that of the second-half pattern and the first-half pattern are described with reference to FIG. 9. FIG. 9 is a flowchart demonstrating an example of pattern-specific operation processing.

First, the control board 23 calculates the operation time under normal circumstances (step S301). That is, the operation time of a water-heating operation performed under normal operation H is calculated.

The control board 23 determines whether or not the calculated operation time is within 3.5 hours (step S302). If the control board 23 determines that the operation time is not within 3.5 hours (exceeds 3.5 hours) (No in step S302), the operation transitions to non-illustrated patterns A and B.

Conversely, when the control board 23 determines that the operation time is within 3.5 hours (Yes in step S302), the control board 23 then determines whether or not the first-half pattern operation or the second-half pattern operation is to be performed for the first time (step S303).

When determining that the first-half pattern operation or the second-half pattern operation is to be performed for the first time (Yes in step S303), the control board 23 acquires the serial number (step S304). As previously described, a set value or a value of a dedicated switch may be acquired instead of the serial number.

The control board 23 determines whether the serial number is an odd number (step S305). When determining that the serial number is an odd number (Yes in step S305), the control board 23 performs operation using the first-half pattern (step S306).

Conversely, when determining that the serial number is not an odd number (being an even number) (No in step S305), the control board 23 performs operation using the second-half pattern (step S307).

In the previously-described step S303, when determining that the first-half pattern operation or the second-half pattern operation is to be performed for the first time (No in step S303), the control board 23 determines whether or not the most-recently executed pattern is the second-half pattern (step S308).

When determining that the second-half pattern is the most-recently executed pattern (Yes in step S308), the control board 23 performs the operation using the first-half pattern (step S309).

Conversely, when determining that the second-half pattern is not the most-recently executed pattern (the first-half pattern is the most-recently executed pattern) (No in step S308), the control board 23 performs the operation using the second-half pattern (step S310).

In this manner, the pattern-specific operation processing causes the first-half pattern operation and the second-half pattern operation to rotate as appropriate. In this pattern-specific operation processing, an example is given in which one operate pattern of the first-half pattern or the second-half pattern is operated that is opposite to the other operation pattern executed last time, and the first-half pattern operation and the second-half pattern operation are rotated as appropriate. Another technique however may be used for appropriately rotating the first-half pattern operation and the second-half pattern operation. For example, the first-half pattern operation and the second-half pattern operation may be appropriately rotated by determining the first-half pattern or the second-half pattern in accordance with even and odd numbers for that particular date (date of operation), for example.

EMBODIMENT 2

In aforementioned Embodiment 1, the operation of the water heater 1 as a stand-alone apparatus is described but the settings data of a plurality of water heaters 1 may be made to be settable (changeable). Below, Embodiment 2 of the present disclosure is described. In Embodiment 2, a configuration is such that settings can be appropriately performed on the water heaters 1 (water heaters 1*a*, 1*b*, 1*c*, 1*d*, . . . ) by taking into account the overall operation state of the water heaters 1. Each of the set water heaters 1 operates autonomously in accordance with the operation pattern in the manner described further above.

Figure 10:
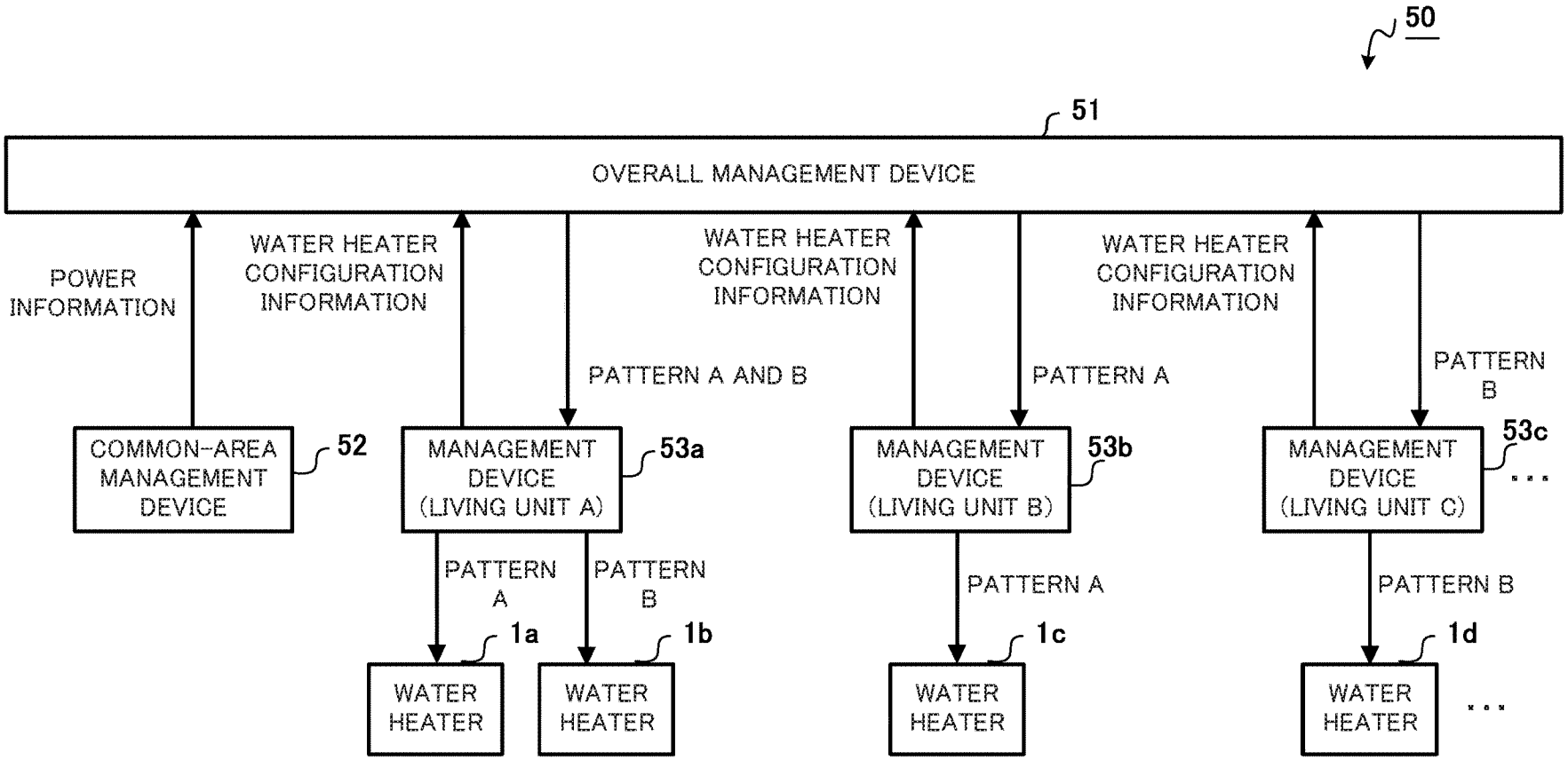
FIG. 10 is a block diagram illustrating an example of a schematic configuration of a water heating system according to Embodiment 2 of the present disclosure.

FIG. 10 is a block diagram illustrating an example of a schematic configuration of a water heating system 50 according to Embodiment 2 of the present disclosure.

As illustrated in FIG. 10, a water heating system 50 includes an overall management device 51, a common-area management device 52, management devices 53 (management devices 53*a*, 53*b*, 53*c*, . . . ), and the water heaters 1 (water heaters 1*a*, 1*b*, 1*c*, 1*c*, 1*d*, . . . ).

The overall management device 51 is a Mansion (Condominium) Energy Management System (MEMS) that performs overall control of the water heating system 50. The overall management system 51 collects information from the common-area management device 52 and each of the management devices 53, and determines an operation pattern (either pattern A or B, for example) of the water heaters 1 on a per-water heater basis such that the overall peak can be reduced. The overall management device 51 notifies each of the water heaters 1 of the determined operation pattern, via the management device 53.

The common-area management device 52 transmits to the overall management device 51 power information of devices to be used in common areas. The devices to be used in the common areas are not limited to devices that consume electricity and may therefore include devices that generate electricity such as photovoltaic power generator, and devices that discharge stored electricity such as a storage battery. In other words, the common-area management device 52 transmits to the overall management device 51 information regarding electricity consumed, information regarding generated (included forecasts) electricity, and information regarding electricity that is discharged, in the common areas of the condominium.

The management device 53 is a Home Energy Management System (HEMS) controller that is installed in each living unit in the condominium. The management device 53 transmits to the overall management device 51 configuration information regarding the water heater 1 (water heater of in the same room) under charge. The configuration information is not limited to the number of water heaters 1 but also includes information regarding standards information and past data of the water heaters 1. The management device 53 receives an operation pattern determined by the overall management device 51 and transmits the operation pattern to the water heater 1 under charge.

Upon receiving the operation pattern, the water heater 1 executes a water-heating operation in accordance with the operation pattern.

Figure 11:
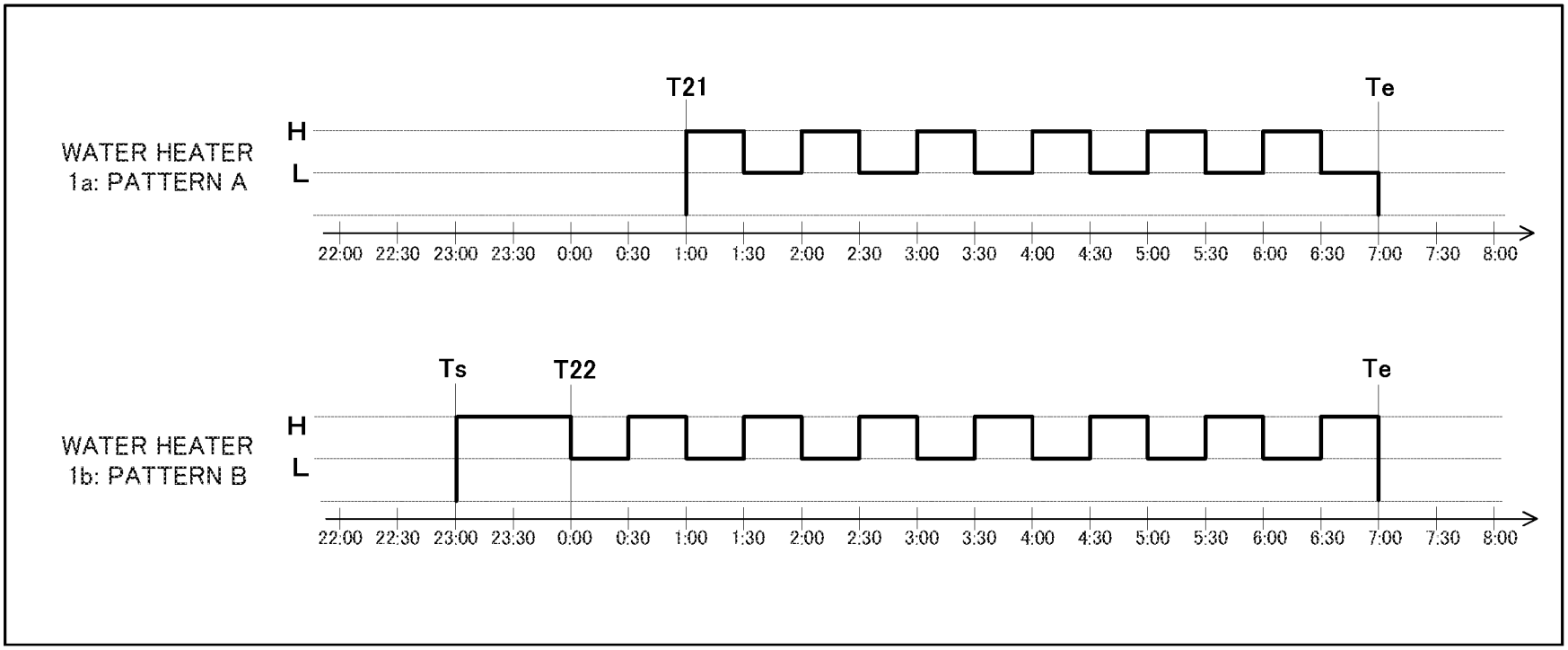
FIG. 11 is an example demonstrating an operation plan following a determined operation pattern.

Specifically, in the water heater 1*a* notified of pattern A, the water heating controller 47 performs a water-heating operation from time T21 (1:00) to time Te (7:00), as illustrated in FIG. 11. In this case, the water-heating operation, in accordance with pattern A, starts from time T21 under normal operation H, and then alternately switches between normal operation H and suppressed operation L each unit time (30 minutes) until time Te.

In contrast to this, in the water heater 1*b* notified of pattern B, the water heating controller 47 performs a water-heating operation from time Ts (23:00) to time Te, as illustrated in FIG. 11. In this case, since the overall management device 51 knows that the water heater 1*a* does not operate until T21, the water heating controller 47 performs the water-heating operation is performed under normal operation H during this unused time until time T22 (0:00), and then time T22, from time Ts to time Te, a water-heating operation is performed in accordance with pattern B, switching in an alternating manner, between normal operation H and suppressed operation L until time Te. In this case, normally, even when the water-heating operation does not finish within the late-night time period, unused time during which other water heaters 1 are not operating can be utilized for performing water-heating operation under normal operation, H thereby enabling water-heating operations to be finished within the late-night time period.

Such kind of a plan in accordance with pattern A and pattern B stipulates that the timing of normal operation H and suppressed the timing of suppressed operation L are different with respect to each other during the late-night time period. This plan further stipulates that unused time during which other water heaters 1 are not operated can be utilized so that a water-heating operation can be performed under normal operation H. Therefore, the water heating controller 47 in each of the water heaters 1 (water heaters 1*a*, 1*b*, 1*c*, 1*d*, . . . ) can reduce the peak when performing water heating control. Therefore, the peak power can be suppressed from arising in the entirety of a condominium or a region.

MODIFIED EXAMPLE OF EMBODIMENT 2

In aforementioned Embodiment 2, although an example is given in which the overall management device 51 transmits an operation pattern on a per-water heater basis to each of the water heaters 1, each of the water heaters 1 may be notified of a value such that even and odd numbers are assigned in a substantially equal manner, and the operation pattern of each of the water heaters 1 may be determined in accordance with the value (even number or odd number) as described in Embodiment 1.

Also, the programs executed by the control board 23 in the aforementioned embodiments may be stored in a computer-readable recording medium such as a compact disc read-only memory (CD-ROM), a digital versatile disc (DVD), a magneto-optical disk (MO), a universal serial bus (USB) memory, and a memory card, and distributed. By installation of this program in a dedicated or general-purpose computer, the computer can function as a control device 2 in the aforementioned embodiments.

The above-described program may be stored on a disk device of a server device on a communication network, such as the Internet, to enable the program to be downloaded to the computer, for example by superimposing the program onto a carrier wave. Moreover, the above-described processing can be achieved even by execution while the program is transferred through the communication network. Furthermore, the above-described processing can be achieved by executing all or part of the program on the server device, and executing the program while sending and receiving by the computer the information relating to such processing through the communication network.

Moreover, if the above-described functions are executed by sharing the functions between an operating system (OS) and application programs, or are executed by both the OS and the application programs in cooperation with each other, the non-OS portion alone may be stored in the above-described recording medium and distributed, or alternatively, may be, for example, downloaded to the computer.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

INDUSTRIAL APPLICABILITY

The present disclosure can be used with advantage for a water heater and a water heating system.

REFERENCE SIGNS LIST

1 Water heater
10 Heat pump unit
11 Compressor
12 Water-refrigerant heat exchanger
13 Expansion valve
14 Air heat exchanger
15 Blower device
20 Tank unit
21 Hot water tank
22 Water pump
23 Control board
24 Indicator
30 Remote controller
41 Settings data storage
42 Past data storage
43 Pattern specifier
44 Heat amount calculator
45 Water-heating heat amount determiner
46 Water heating scheduler
47 Water heating controller
48 Communicator
50 Water heating system
51 Overall management device
52 Common-area management device
53 Management device

The invention claimed is:

1. A hot-water storage type water heater configured to operate autonomously in accordance with an operation pattern, the water heater comprising:

a controller configured to alternately switch between a first operation and a second operation to heat water in accordance with the operation pattern of a plurality of operation patterns, the operation pattern being determined based on whether a value set for the water heater is an even number or an odd number, the first operation operating at a high capacity, and the second operation operating at a capacity lower than that of the first operation.

2. The water heater according to claim 1, wherein the controller alternately switches between the first operation and the second operation each unit time to heat water.

3. The water heater according to claim 1, further comprising:

a pattern determiner configured to determine the operation pattern based on whether a set serial number is an even number or an odd number, the operation pattern corresponding to the serial number, the plurality of operation patterns including two operation patterns each having a timing of the first operation and a timing of the second operation, and the two operation patterns having operation timings different from each other;

a heat amount determiner configured to determine a heat amount necessary for water heating; and a plan establisher configured to establish a water heating plan based on the operation pattern determined by the pattern determiner and the water-heating heat amount determined by the heat amount determiner, wherein the controller performs a water-heating operation alternately switching between the first operation and the second operation based on the water heating plan established by the plan establisher.

4. The water heater according to claim 3, wherein when a water heating plan in a predetermined late-night time period is established, the plan establisher changes a capacity value in the second operation such that the water heating plan is completed within the late-night time period.

5. The water heater according to claim 3, wherein when the water-heating heat amount determined by the heat amount determiner is only obtainable within a predetermined time by the first operation, the plan establisher establishes a water heating plan in which water heating is performed in a first-half or a second-half of a predetermined late-night time period.

6. A water heating system comprising:

hot-water storage type water heaters configured to operate autonomously in accordance with an operation pattern; and an overall management device configured to notify the water heaters regarding a value, wherein:

the overall management device collects information regarding each of the water heaters and notifies each of the water heaters regarding the value for allocating a plurality of operation patterns equally among the water heaters, and, each of the water heaters alternately switches between a first operation and a second operation to heat water in accordance with the operation pattern of the plurality of operation patterns, the operation pattern being determined based on whether the value sent as a notification by the overall management device is an even number or an odd number, the first operation operating at a high capacity, and the second operation operating at a capacity lower than that of the first operation.

* * * * *